US009478871B2

(12) United States Patent
Hsu et al.

(10) Patent No.: US 9,478,871 B2
(45) Date of Patent: Oct. 25, 2016

(54) WIDEBAND BOW TIE ANTENNA

(71) Applicant: Yuan Ze University, Tao-Yuan County (TW)

(72) Inventors: Heng-Tung Hsu, Tao-Yuan County (TW); Ting-Jui Huang, Tao-Yuan County (TW)

(73) Assignee: YUAN ZE UNIVERSITY, Tao-Yuan County (TW)

( * ) Notice: Subject to any disclaimer, the term of this patent is extended or adjusted under 35 U.S.C. 154(b) by 253 days.

(21) Appl. No.: 14/250,310

(22) Filed: Apr. 10, 2014

(65) Prior Publication Data

US 2015/0295325 A1 Oct. 15, 2015

(51) Int. Cl.

| | |
|---|---|
| ***H01Q 21/26*** | (2006.01) |
| ***H01Q 19/10*** | (2006.01) |
| ***H01Q 9/28*** | (2006.01) |
| ***H01Q 19/00*** | (2006.01) |

(52) U.S. Cl.

CPC ..... *H01Q 19/108* (2013.01); *H01Q 9/285* (2013.01); *H01Q 19/00* (2013.01); *H01Q 21/26* (2013.01)

(58) Field of Classification Search

USPC ..... 343/797, 700 MS, 702

See application file for complete search history.

(56) References Cited

U.S. PATENT DOCUMENTS

| | | | | |
|---|---|---|---|---|
| 6,888,511 | B2 * | 5/2005 | Cake | H01Q 9/265 343/803 |
| 7,990,332 | B1 * | 8/2011 | Tischer | H01Q 1/125 343/810 |

* cited by examiner

*Primary Examiner* — Hoang V Nguyen
*Assistant Examiner* — Hai Tran
(74) *Attorney, Agent, or Firm* — Chun-Ming Shih

(57) ABSTRACT

A wideband bow tie antenna includes a guiding unit, a radiating unit, and a reflecting unit. The radiating unit is configured between the guiding unit and the reflecting unit. The radiating unit includes a guiding substrate and a guiding patch configured on the guiding substrate. The radiating unit includes a radiating substrate and a first bow tie radiator which is configured on the radiating substrate and coupled with the guiding patch. The first bow tie radiator includes two single radiating portions which are symmetrically configured to each other. The reflecting unit includes a reflecting substrate and a loop reflecting patch which are configured on the reflecting substrate and coupled with the first bow tie radiator.

5 Claims, 9 Drawing Sheets

WIDEBAND BOW TIE ANTENNA

FIELD OF THE INVENTION

The present invention is about a wideband bow tie antenna. More particularly, the present invention is about a wideband bow tie antenna applying a guiding unit and reflecting unit for improving wideband characters.

DESCRIPTION OF THE PRIOR ART

Nowadays wireless communication devices cover different spectrums to meet demands of multimedia wideband communication. Such as 2G/3G/4G wireless communication protocols, Wi-Fi, Global Position System (GPS), and etc. Each particular spectrum corresponds to a particular antenna for transmission. For the compact demands of size in wireless communication devices, a single antenna covering most communication bandwidths becomes a substantial technical issue.

Conventionally, a normal wideband antenna like bow tie antenna, monopole antenna, spiral antenna, and biconical antenna is omnidirectional antenna, and the gain is usually low. Besides, this kind of antenna, due to its omnidirectional character, is influenced when it is placed near a dielectric material without ground plane protection, and the radiation characters are influenced by the dielectric material. Thus, the antenna cannot meet default radiation demands.

For overcoming the previous problems, conventional technologies provided directional antenna such as log periodic antenna, Vivaldi antenna, and etc. However, the previous antennas only have monopole radiation pattern, which limits in receiving polarized electromagnetic waves from particular direction.

Therefore, the technical field needs wideband antenna for receiving dipole radiation pattern.

SUMMARY OF THE INVENTION

To solve the previous technical problems, one objective of the present invention is to provide a wideband bow tie antenna to solve problem of limited bandwidth of conventional antennas.

To achieve the aforementioned objective, the present invention provides a wideband bow tie antenna. The wideband bow tie antenna comprises a guiding unit, a radiating unit, and a reflecting unit. The guiding unit further comprises a guiding substrate, and a guiding patch being configured on a plane of the guiding substrate. The radiating unit is adjacent to the guiding unit, and the radiating unit further comprises a radiating substrate and a first bow tie radiator. The first bow tie radiator is configured on a plane of the radiating substrate and further coupled to the guiding patch. The first bow tie radiator further comprises two single radiating portions which are symmetrically configured to each other. The width of the each single radiating portion increases from the feeding end of the bow tie radiating portion to the end of the each single radiating portion. The reflecting unit is adjacent to the radiating unit, and the reflecting unit further comprises a reflecting substrate and a loop reflecting patch being configured on a plane of the reflecting substrate. The loop reflecting patch is further coupled with the first bow tie radiator. And the radiating unit is configured between the guiding unit and the reflecting unit.

Different from conventional Yagi antenna, wherein the guiding unit thereof is only able to enhance uni-direction corresponding to mono polarized radiation wave, the guiding patch of the present invention is able to enhance direction corresponding to horizontal and vertical polarized radiation wave. And the loop reflecting patch is able to enhance direction of low-frequency radiation wave generated by the radiating unit. Comparing with the conventional antennas, the wideband bow tie antenna of the present invention is advantaged in good gain, and having the loop reflecting patch for reducing distance between the reflecting unit and the radiating unit. Thus, a more compact antenna with good gain performance is achieved.

DETAILED DESCRIPTION OF THE PREFERRED EMBODIMENT

The following description is about embodiments of the present invention; however it is not intended to limit the scope of the present invention.

Figure 1:
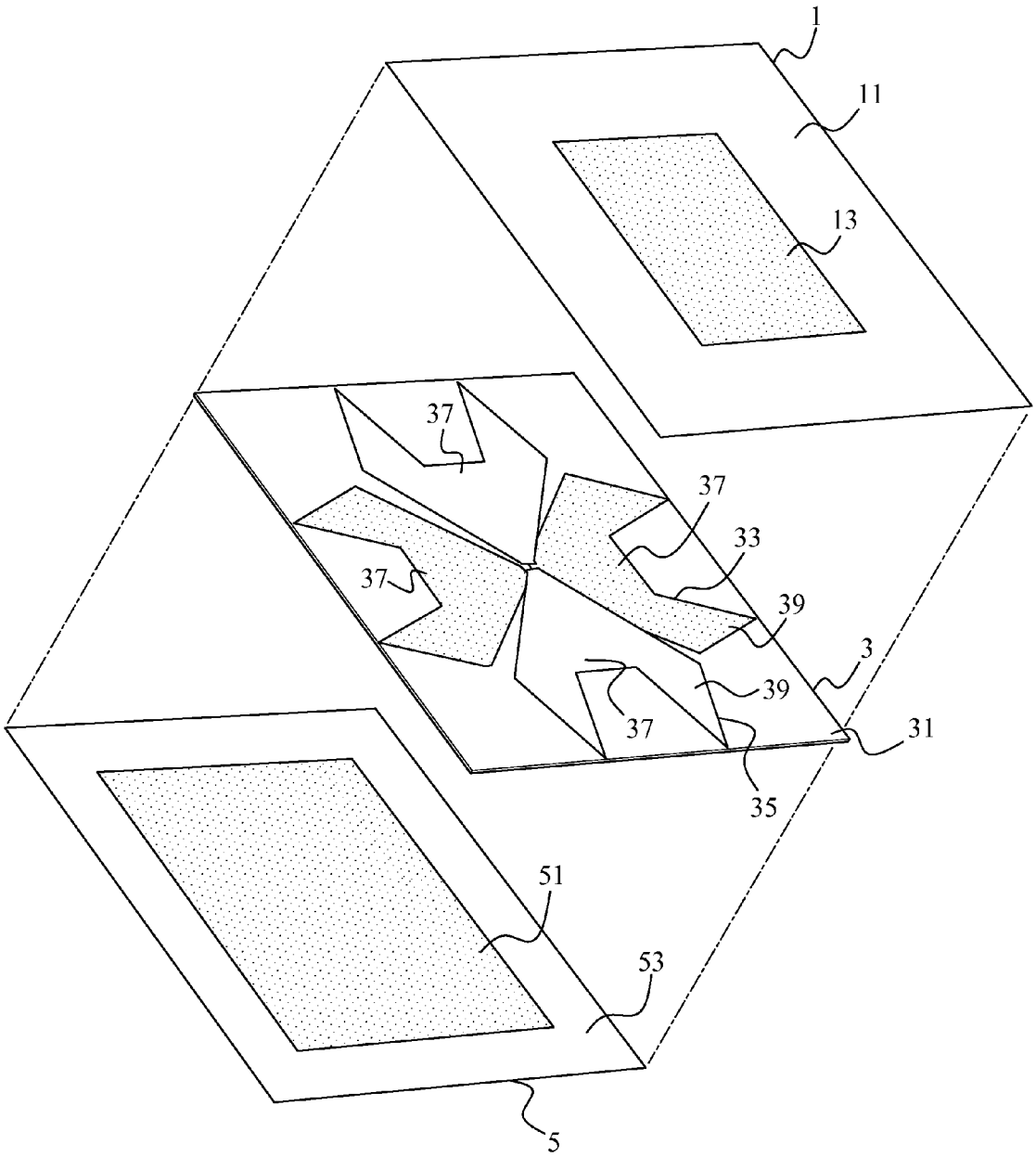
FIG. 1 shows a wideband bow tie antenna diagram of the present invention.

FIG. 1 shows a wideband bow tie antenna of the present invention. The wideband bow tie antenna comprises a guiding unit 1, a radiating unit 3, and a reflecting unit 5. The guiding unit 1 is configured to enhance the direction of the wideband bow tie antenna. The guiding unit 1 further comprises a guiding substrate 11, a guiding patch 13 configured on a plane of the guiding substrate 11. The radiating unit 3 is adjacent to the guiding unit 1. The radiating unit 3 further comprises a radiating substrate 31, and a first bow tie radiator 33. The first bow tie radiator 33 is configured on a plane of the radiating substrate 31. The first bow tie radiator 33 is further coupled to the guiding patch 13. The first bow tie radiator 33 further comprises two single radiating portions 37 which are symmetrically configured to each other according to the feeding end. The width of the each single radiating portion 37 increases from the feeding end of the bow tie radiating portion 37 to the end of the each single radiating portion 37. By setting the size of the single radiating portion 37, it is able to adjust impedance matching and radiation efficiency of the wideband bow tie antenna. The reflecting unit 5 is adjacent to the radiating unit 3, and the radiating unit 3 is further configured between the guiding unit 1 and the reflecting unit 5. The reflecting unit 5 further comprises a reflecting substrate 51 and a loop reflecting patch 53. The loop reflecting patch 53 is configured on a plane of the reflecting substrate 51, the loop reflecting patch 53 is further coupled with the first bow tie radiator 33.

The aforementioned guiding patch 13, the first bow tie radiator 33, and the loop reflecting patch 53 are made of good conductor materials, such as copper or aluminum. The guiding substrate 11, the radiating substrate 31, and the reflecting substrate 51 are made of dielectric materials, such as ceramic, bakelite, or styrofoam.

Figure 2:
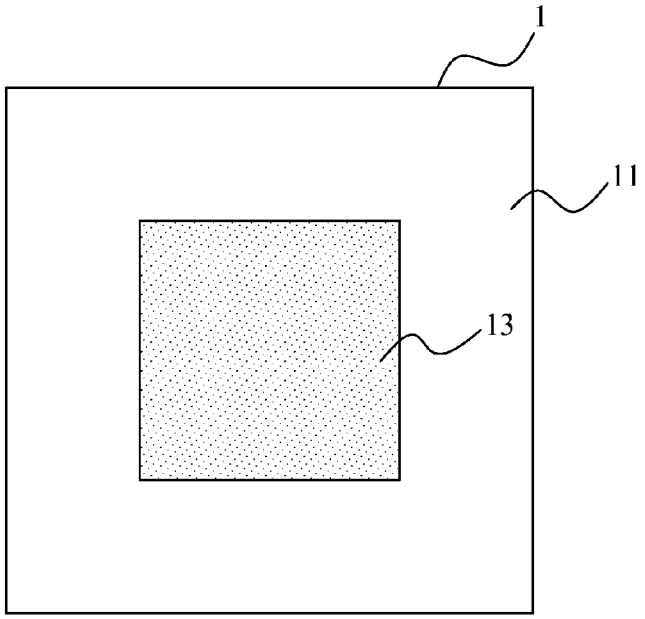
FIG. 2 shows a guiding unit structure diagram of the wideband bow tie antenna of the present invention.

FIG. 2 shows the guiding unit 1 of the wideband bow tie antenna. The shape of the guiding patch 13 is at least one selected from square, circle, triangle or combination thereof. When the shape of the guiding patch 13 is square, it is able to guide horizontally polarized or vertically polarized radiation waves provided by the radiating unit 3. This is different from the conventional Yagi antenna, wherein the guiding unit thereof is only able to enhance uni-direction corresponding to mono polarized radiation wave.

Figure 3:
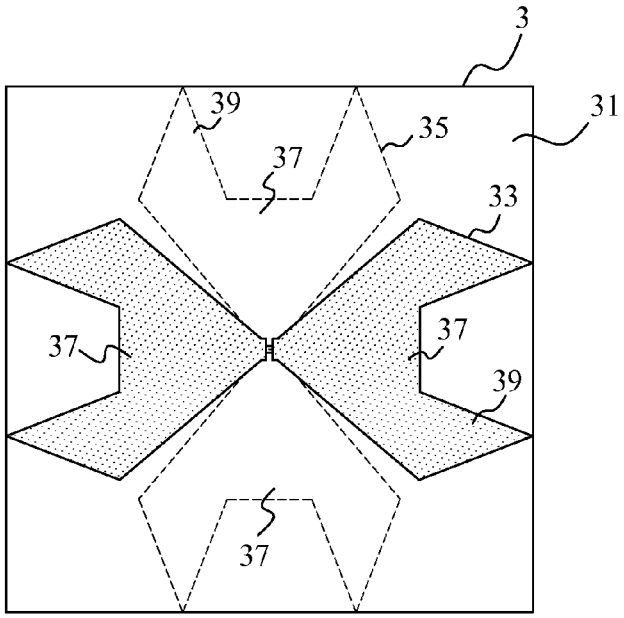
FIG. 3 shows a radiating unit structure diagram of the wideband antenna of the present invention.

FIG. 3 jointly with FIG. 1 shows radiating unit 3 of the wideband antenna. The wideband bow tie antenna is able to correspond to polarization styles of radiation, such as single polarization, dual polarization, and circular polarization. A second bow tie radiator 35 is selected. The second bow tie radiator 35 is substantially the same as the first bow tie radiator 33. The second bow tie radiator 35 is further coupled with the guiding patch 13 and the loop reflecting patch 53. An angle which is formed between the direction of parallel center axis of the second bow tie radiator and the direction of parallel center axis of the first bow tie radiator is adjustable corresponding to various polarization statuses, such as in 30 degrees, 60 degrees, or 90 degrees (i.e. orthogonal). The parallel center axis of the first bow tie radiator 33 is parallel with the radiating substrate 31 and through the center line of the two signal radiating portions 37. The parallel center axis of the second bow tie radiator 35 is also parallel with the radiating substrate 31 and through the center line of the two signal radiating portions 37. The vertical center axis of the second bow tie radiator 35 and the vertical center axis of the first bow tie radiator 33 are overlapping or nearby corresponding to different polarization status. The vertical center axis of the first bow tie radiator 33 is perpendicular to the radiating substrate 31 and within center of the two signal radiating portions 37. The vertical center axis of the second bow tie radiator 35 is also perpendicular to the radiating substrate 31 and within center of the two signal radiating portions 37. Each of the single radiating portion 37 further comprises two side reflecting patches 39, each sided patch 39 attaches the end side of each single radiating portion 37, and the each single radiating patch 39 is adjacent to one of two end points of the each single radiating portion 37. The shape of sided patch 39 is triangle.

If one embodiment comprises the first bow tie radiator 33 and the second bow tie radiator 35, and the direction of parallel center axis of the second bow tie radiator 35 and the direction of parallel center axis of the first bow tie radiator 33 are orthogonal to each other, and the vertical center axis of the second bow tie radiator 35 and the vertical center axis of the first bow tie radiator 33 are overlapping, then it is able to generate dual polarization radiation wave when inputting signal to the feeding ends of the first bow tie radiator 33 and the second bow tie radiator 35.

Figure 4:
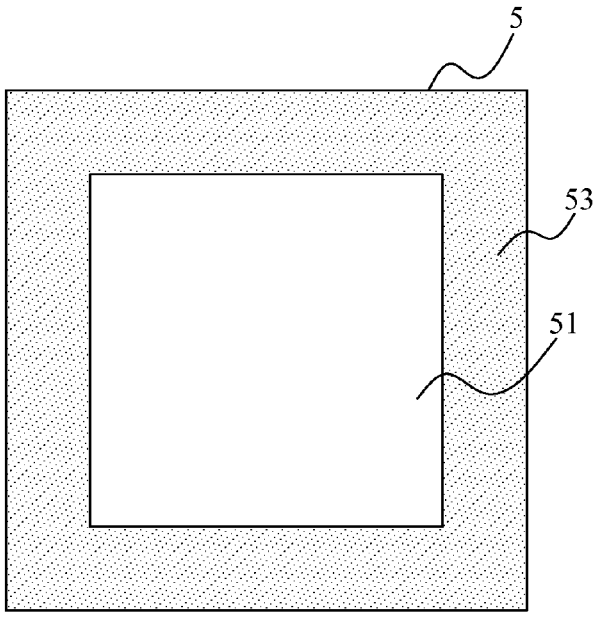
FIG. 4 shows a reflecting unit structure diagram of the wideband bow tie antenna of the present invention.

FIG. 4 shows the reflecting unit 5 of the wideband bow tie antenna. The shape of the loop reflecting patch 53 of the reflecting unit 5 is at least one selected from square loop, circle loop, triangle loop or combination thereof.

Figure 5:
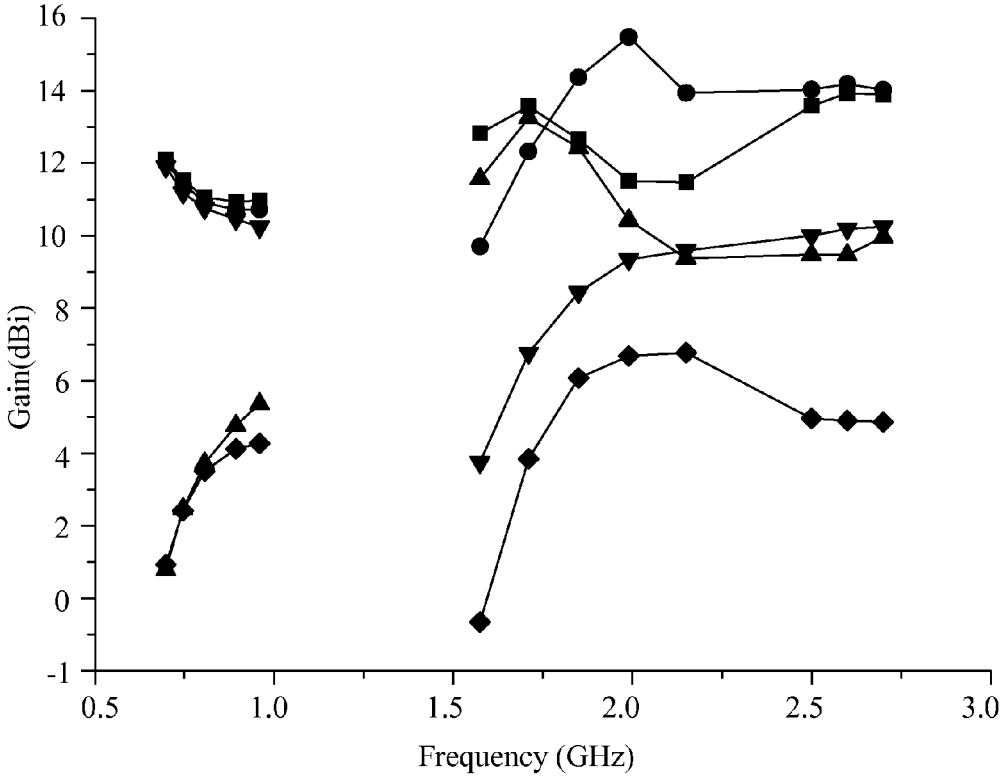
FIG. 5 shows comparison diagram of gain/frequency of the wideband bow tie antenna of the present invention.

FIG. 5 shows effect of direction gain (dBi) of the wideband bow tie antenna caused by the reflecting unit 5 and guiding unit 1. And each curve represents different combination status as below:

| curve | Line segment | inner elements combination of the wideband bow tie antenna |
|---|---|---|
| A | Square node segment | comprising a guiding unit 1, a radiating unit 3, and a reflecting unit 5, wherein size of the guiding patch 13 is corresponding to half wavelength below 1.7 GHz operation frequency |
| B | Circle node segment | comprising a guiding unit 1, a radiating unit 3, and a reflecting unit 5, wherein size of the guiding patch 13 is corresponding to half wavelength below 2 GHz operation frequency |
| C | Up triangle node segment | only comprising a guiding unit 1, and a radiating unit 3 |
| D | Down triangle node segment | only comprising a radiating unit 3, and a reflecting unit 5 |
| F | Diamond node segment | Only comprising a radiating unit 3 |

Refer to FIG. 5; it is known that when the wideband bow tie antenna only comprises the radiating unit 3, the gain of the antenna is 2-3 dBi. Also, the effects in low-frequency gain and high-frequency gain of the wideband bow tie antenna caused by the reflecting unit 5 and the guiding unit 1 are known. According to the curve A and curve B, it is known that the size of the guiding patch 13 is configured to determine the high-frequency gain.

Figure 6:
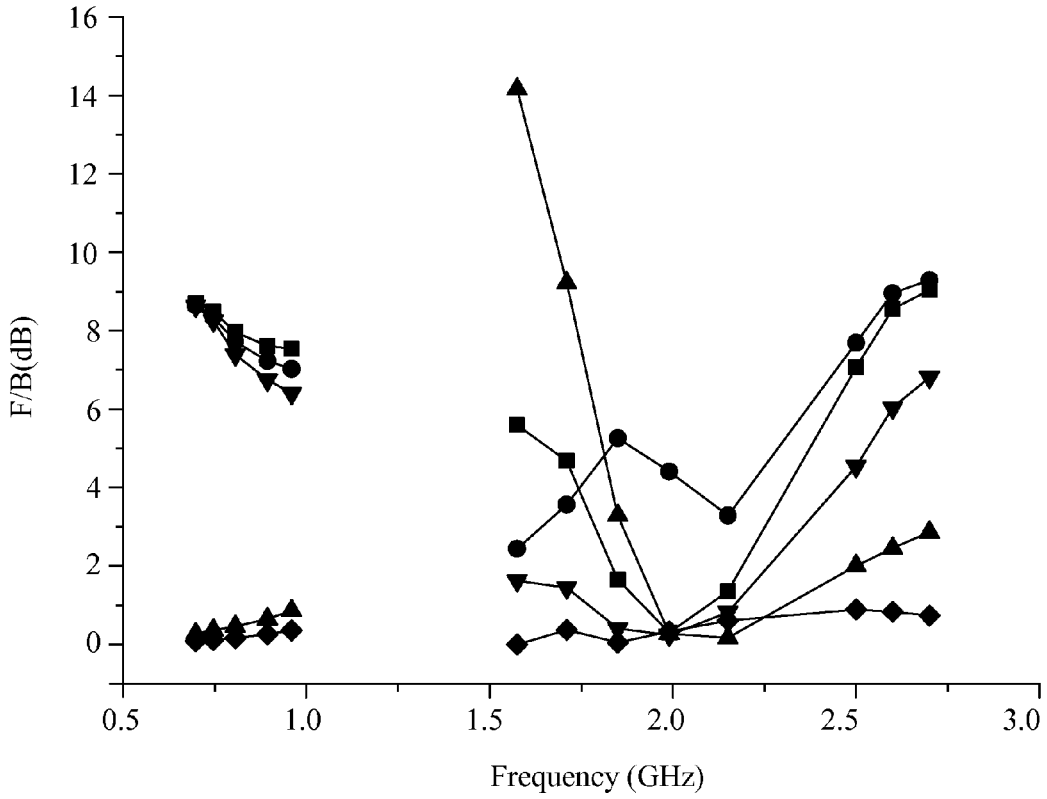
FIG. 6 shows a comparison diagram of front to back ratio (F/B)/frequency of the wideband bow tie antenna of the present invention.

FIG. 6 shows the front to back ratio, F/B, of the wideband bow tie antenna caused by the reflecting unit 5 and the guiding unit 1. The F/B represents field amplitude ratio of main lobe and back lobe. According to curves A and B, it is known that when the wideband bow tie antenna comprises radiating unit 3, reflecting unit 5, and guiding unit 1, high-frequency (2.5 GHz~2.7 GHz) F/B is effectively enhanced.

Figure 7A:
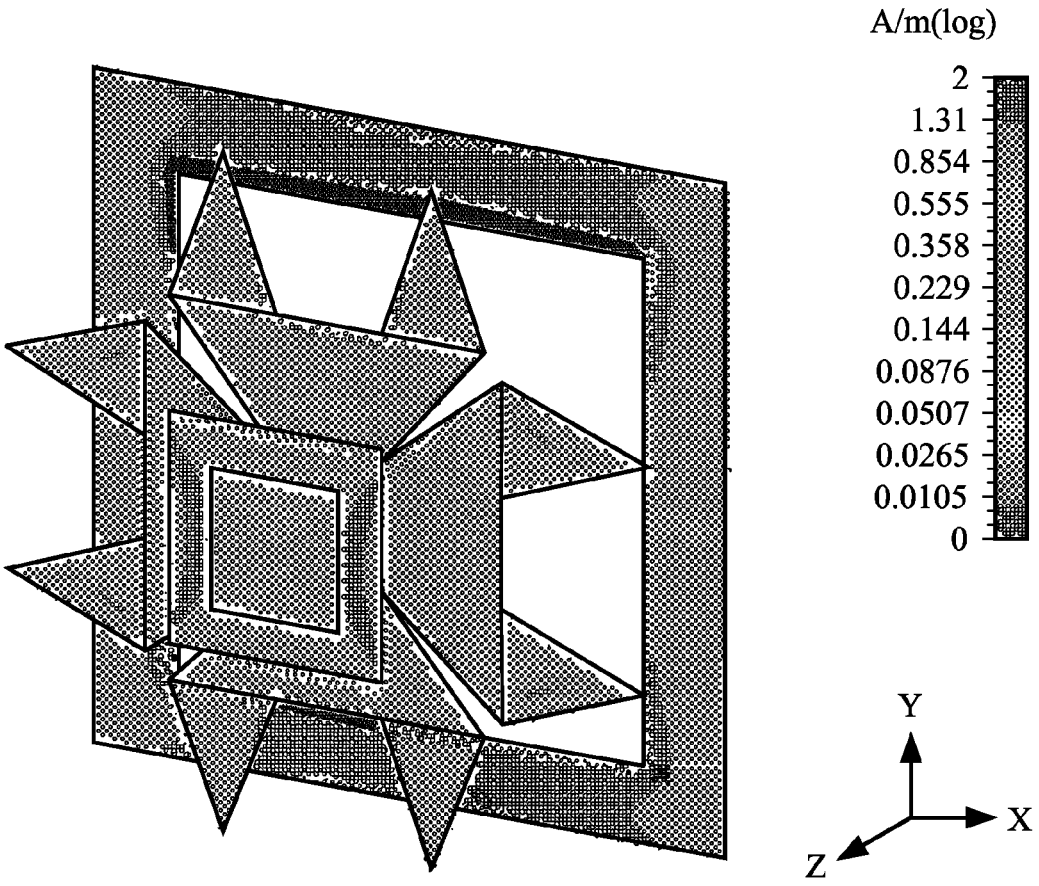
FIG. 7A shows current distribution diagram in low-frequency of the wideband bow tie antenna of the present invention.
Figure 7B:
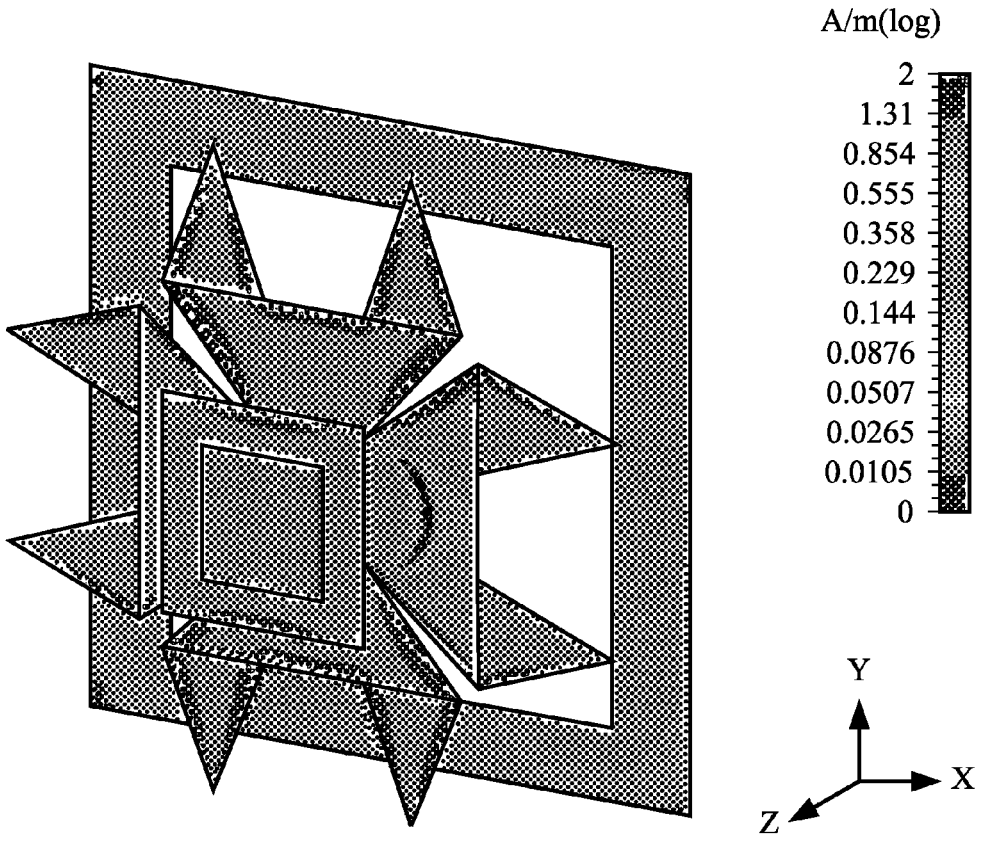
FIG. 7B shows current distribution diagram in mid-frequency of the wideband bow tie antenna of the present invention.
Figure 7C:
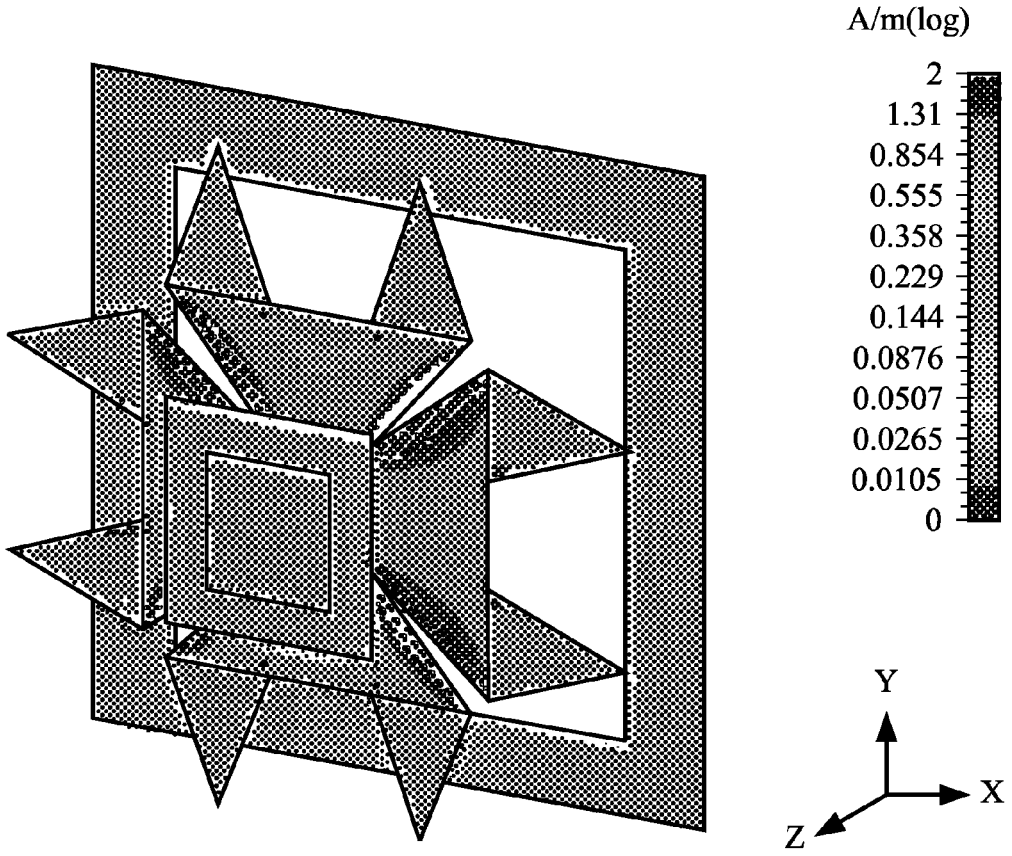
FIG. 7C shows current distribution diagram in high-frequency of the wideband bow tie antenna of the present invention.

FIG. 7A shows current distribution in low-frequency (0.698 GHz~0.96 GHz) of the wideband bow tie antenna. According to the current distribution of loop reflecting patch 53, the loop reflecting patch 53 is configured to provide reflection function of low-frequency radiation wave. FIG. 7B shows current distribution in mid-frequency (1.71 GHz~2.45 GHz) of the wideband bow tie antenna. According to the current distribution of guiding patch 13, the guiding patch 13 is configured to determine mid-frequency radiation characters. FIG. 7C shows current distribution in high-frequency (2.5 GHz~2.7 GHz) of the wideband bow tie antenna. According to the uniform current distribution of guiding patch 13 and loop reflecting patch 53, the guiding patch 13 and loop reflecting patch 53 are configured to determine high-frequency radiation characters.

Figure 8A:
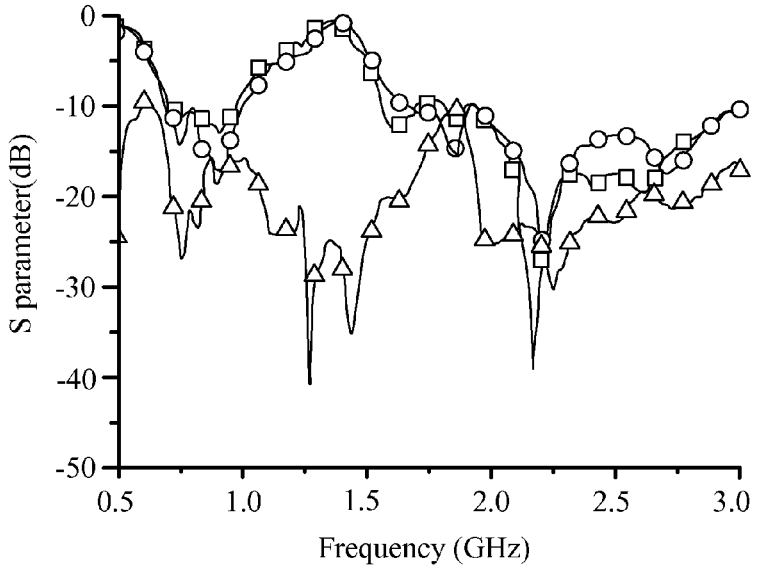
FIG. 8A shows the S parameter diagram of the wideband bow tie antenna of the present invention.

FIG. 8A shows the S parameter diagram of the wideband bow tie antenna. Within operation frequency bandwidth (698 MHz~960 MHz, 1710 MHz~2700 MHz) of Long Term Evolution, LTE, the reflecting loss parameter (S11, diamond node curve) of the first bow tie radiator 33 and the reflecting loss parameter (S22, circle node curve) of the second bow tie radiator 35 are both smaller than −10 dB. And the isolation parameter (S21, up triangle node curve) between the first bow tie radiator 33 and the second bow tie radiator 35 is as below: smaller than −15 dB in low-frequency (0.698 GHz~0.960 GHz), smaller than −11 dB in mid-frequency (1.71 GHz~2.45 GHz), and smaller than −20 dB in high-frequency (2.5 GHz~2.7 GHz). The aforementioned S parameters meet regulations of antenna operation.

Figure 8B:
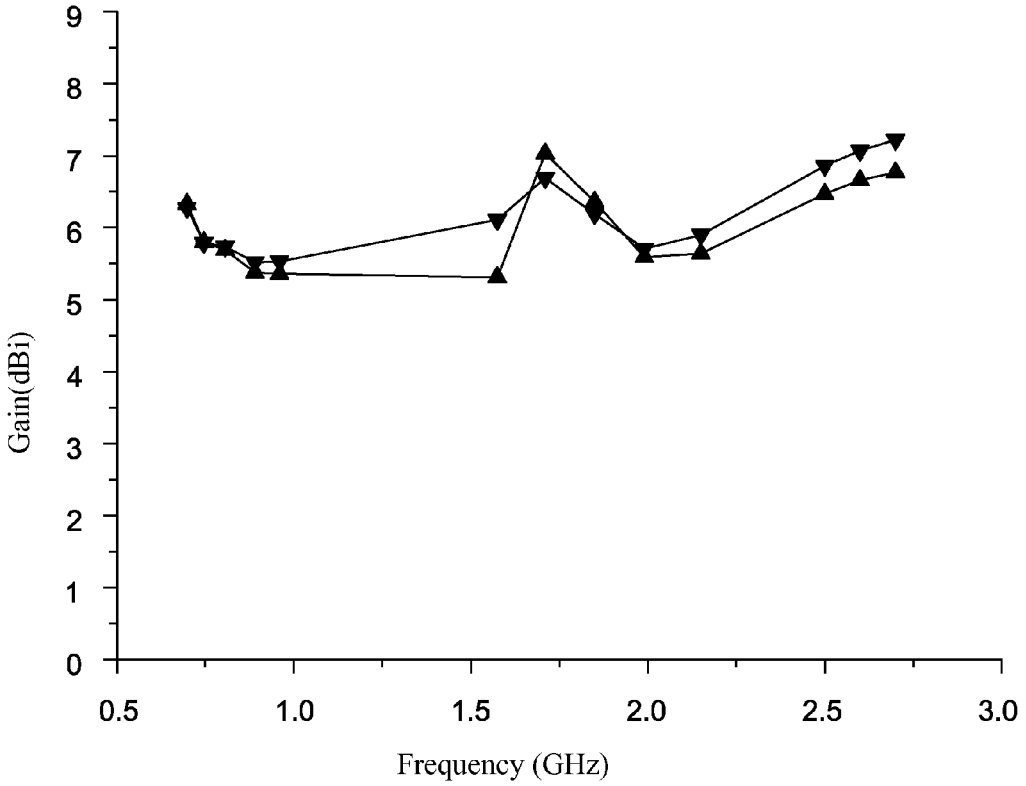
FIG. 8B shows gains of horizontal polarization and vertical polarization of the wideband bow tie antenna of the present invention.

FIG. 8B shows gains of horizontal polarization and vertical polarization of the wideband bow tie antenna. The up triangle node curve represents horizontal polarization, and the down triangle node curve represents vertical polarization. Refer to FIG. 8B; it is known that the gain of the wideband bow tie antenna is above 6 dBi in all designated frequencies.

Figure 8C:
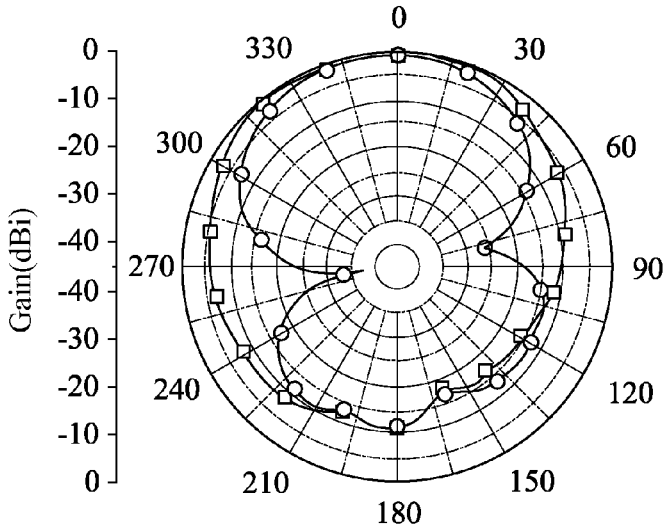
FIG. 8C shows 2D radiation diagram of the wideband bow tie antenna of the present invention.
Figure 8D:
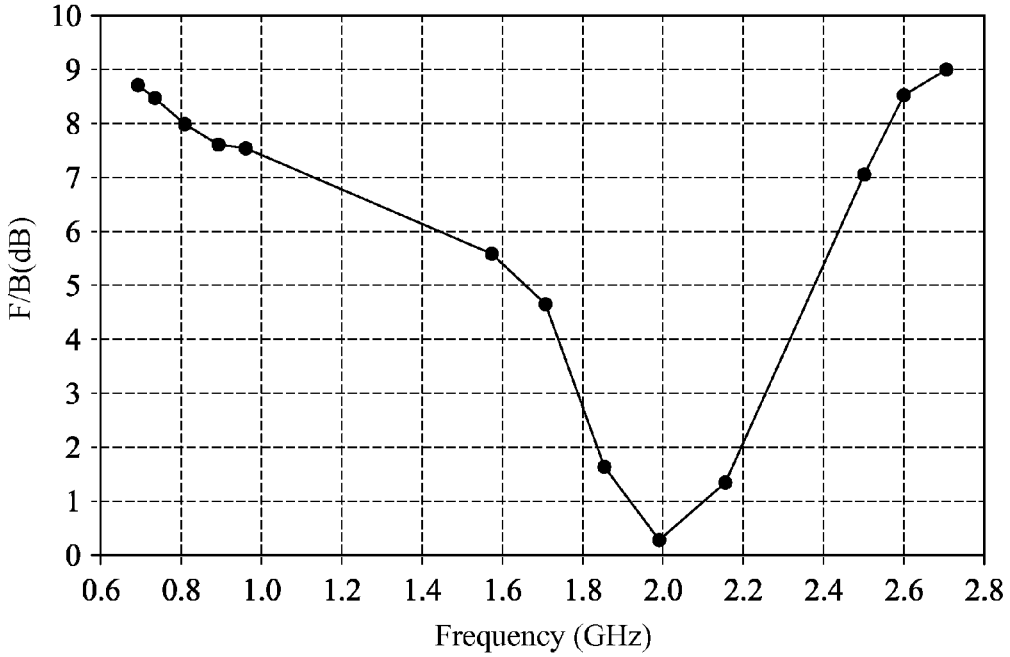
FIG. 8D shows the F/B diagram of the wideband bow tie antenna of the present invention.

FIG. 8C shows 2D radiation diagram of the wideband bow tie antenna of the present invention (default frequency is 698 MHz). Square node curve represents radiation field of XZ-plane, circle node curve represents radiation field of YZ-plane. FIG. 8D shows the F/B diagram of the wideband bow tie antenna of the present invention. The F/B is above 7 dB in both low-frequency (0.698 GHz~0.96 GHz) and high-frequency (2.5 GHz~2.7 GHz).

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A wideband bow tie antenna, comprising:

a guiding unit, comprising:

a guiding substrate;

a square guiding patch, configured on a plane of the guiding substrate;

a radiating unit, adjacent to the guiding unit, the radiating unit further comprising:

a radiating substrate;

a first bow tie radiator, configured on a first plane of the radiating substrate, the first bow tie radiator further coupled to the guiding patch, the first bow tie radiator further comprising two single radiating portions which are symmetrically configured to each other, the width of each single radiating portion increasing from a feeding end of the bow tie radiating portion to an end of the each single radiating portion;

a second bow tie radiator, substantially the same as the first bow tie radiator and configured on a second plane opposite to the first plane of the radiating substrate;

a reflecting unit, adjacent to the radiating unit, the radiating unit further configured between the guiding unit and the reflecting unit, the reflecting unit further comprising:

a reflecting substrate;

a loop reflecting patch, configured on a plane of the reflecting substrate, the loop reflecting patch further coupled with the first bow tie radiator, wherein the second bow tie radiator further coupled with the square guiding patch and the loop reflecting patch, wherein a direction of a parallel center axis of the second bow tie radiator and a direction of a parallel center axis of the first bow tie radiator are orthogonal to each other, and wherein a vertical center axis of the second bow tie radiator and a vertical center axis of the first bow tie radiator are overlapping.

2. The wideband bow tie antenna as claimed in claim 1, wherein the shape of the guiding patch is selected from square, circle, triangle or combination thereof.

3. The wideband bow tie antenna as claimed in claim 1, wherein the shape of the loop reflecting patch is selected from square loop, circle loop, triangle loop or combination thereof.

4. The wideband bow tie antenna as claimed in claim 1, wherein the each single radiating portion further comprises two sided patches, one side of the each sided patch attaching end side of the each single portion, the each sided radiating patch adjacent to one of two end points of the each single radiating portion.

5. The wideband bow tie antenna as claimed in claim 4, wherein the shape of the two sided patches are triangle.

* * * * *